US006477876B1

(12) United States Patent
Kim

(10) Patent No.: US 6,477,876 B1
(45) Date of Patent: Nov. 12, 2002

(54) LOCK CONSTRUCTION

(76) Inventor: Jung K. Kim, 1223-6 Sankyeok-4Dong, Buk-Gu, Taegu (KR), 702-014

( * ) Notice: Subject to any disclaimer, the term of this patent is extended or adjusted under 35 U.S.C. 154(b) by 0 days.

(21) Appl. No.: 09/709,080

(22) Filed: Nov. 8, 2000

(30) Foreign Application Priority Data

Dec. 10, 1999 (KR) ..... 99-28639

(51) Int. Cl.[7] ..... E05B 27/00
(52) U.S. Cl. ..... 70/495; 70/409; 70/493
(58) Field of Search ..... 70/492–495

(56) References Cited

U.S. PATENT DOCUMENTS

| | | | | | |
|---|---|---|---|---|---|
| 2,105,659 | A | * | 1/1938 | Jacobi | 70/364 |
| 2,283,489 | A | * | 5/1942 | Crousore | 70/419 |
| 2,629,249 | A | * | 2/1953 | Mendelsohn | 70/419 |
| 3,455,130 | A | * | 7/1969 | Basseches | 70/421 |
| 4,393,673 | A | * | 7/1983 | Widen | 70/358 |
| 5,067,335 | A | * | 11/1991 | Widen | 70/495 |
| 5,582,050 | A | * | 12/1996 | Haggstrom | 70/495 |
| 5,640,865 | A | * | 6/1997 | Widen | 70/495 |
| 5,809,816 | A | * | 9/1998 | Widen | 70/493 |
| 5,845,525 | A | * | 12/1998 | Widen | 70/493 |
| 6,119,495 | A | * | 9/2000 | Loreti | 70/340 |

FOREIGN PATENT DOCUMENTS

| | | | | |
|---|---|---|---|---|
| EP | 0 103 532 A2 | * | 9/1983 | E05B/27/00 |
| GB | 2 239 040 A | * | 11/1989 | |
| KR | 199928639 | | 12/1999 | |

* cited by examiner

*Primary Examiner*—Robert J. Sandy
*Assistant Examiner*—André L. Jackson
(74) *Attorney, Agent, or Firm*—John K. Park; Park & Sutton LLP

(57) ABSTRACT

A lock construction that minimizes the friction coefficient between the slide pin and the slide pin hole through the design of an arc-shaped indentation formed on each interior wall of the slide pin holes, which receives the rectangular slide pin. The lock construction includes an outer fixed body and an inner rolling body, a hooking recess formed in an inner peripheral surface portion, a receiving recess formed in an outer peripheral surface portion of the inner rolling body, wherein a slide bar having a linearly formed inner side is elastically provided in the locking construction, wherein about five slide pin holes of rectangular shape are formed perpendicular to the receiving recess, wherein an arc-shaped indentation is formed on each interior wall of the slide pin holes. A plurality of rectangular slide pins with grooves differing in height and protrusions differently opposing the grooves so that the grooves may serve as the receiving recess and the protrusions may open to and be received by the openings.

4 Claims, 6 Drawing Sheets

LOCK CONSTRUCTION

CLAIMING FOREIGN PRIORITY

The applicant claims and requests a foreign priority, through the Paris Convention for the Protection of Industrial Property, based on a patent application filed in the Republic of Korea (South Korea) with the filing date of Dec. 10, 1999, with the application number 1999-28639, by the applicant. (See the Attached Declaration)

BACKGROUND OF THE INVENTION

The present invention relates to a lock construction, and more particularly to an improved lock construction that enhances locking performance by simplifying a slide bar and slide pins required for locking or unlocking a lock.

As shown in FIG. 6, a slide bar according to a conventional lock includes a plurality of protrusions 51 along the inner side of the slide bar 50. A plurality of recesses 53 are formed along the outer periphery of the pin 52. Such a conventional lock construction requires a considerable number of processing steps while deteriorating productivity due to difficult in precision manufacturing, thereby increasing production cost while disadvantageously reducing the ease of unlocking.

Also, each pin and the hole for receiving the pin are formed cylinderically so that the friction on area becomes too large during the locking or unlocking operation and the pin is exposed to contact, friction and stress about the entire circumference, thereby interrupting and hindering a smooth locking operation. Further, because the locking c construction is mechanically sensitive, such a slight abrasion may damage product reliability.

SUMMARY OF THE INVENTION

The present invention is devised and contrived to overcome the conventional disadvantages. Accordingly, it is an object of the present invention to provide a lock construction which decreases difficulty in unlocking and increases product lifecycle, while further facilitating the locking/unlocking operation.

It is a substantial advantage to reduce the surface area contact between the rectangular slide pins and the slide pin holes to improve ease of operation in the locking and unlocking steps. This ease of operation is accomplished by matching the shape of the rectangular slide pin and arc shaped indentations in the slide pin holes to minimize their surface area contact. Alternate shapes of the rectangular slide pin and indentations are possible, which accomplish the same advantage and objective of reducing and minimizing surface area contact and friction during the sliding movement.

To achieve the above-described object, the lock construction according to the present invention includes an outer fixed body and an inner rolling body, a hooking recess formed in an inner peripheral surface portion of the outer fixed body. A receiving recess formed in an outer peripheral surface portion of the inner rolling body. A slide bar having a linearly formed inner side is elastically provided in the locking construction. About five slide pin holes in rectangular are formed perpendicular to the receiving recess. An arc-shaped indentation is formed on each interior wall of the slide pin holes. A plurality of rectangular slide pins have grooves located at different heights on the rectangular slide pins and protrusions differently opposing the grooves so that the grooves may receive the slide bar and the protrusions may open to the openings.

When the rectangular slide pins fluctuate through the respective slide pin holes, the arc-shaped indentations formed on each interior wall of the slide pin holes decrease the surface friction area, thereby smoothing the fluctuation movement of the rectangular slide pins. It is a substantial advantage to reduce the surface area contact between the rectangular slide pins and the slide pin holes to improve ease of operation in the locking and unlocking steps. Although not illustrated in the drawings, an embodiment of the lock construction has the entire interior wall of the slide pin hole as arc shaped, thus forming a circular slide pin hole.

In summary and further detailed explanation the lock construction includes an outer fixed body having a hooking recess. An inner rolling body having a receiving recess. A slide bar having a linearly formed inner side. A plurality of slide pins having grooves and protrusions. A plurality of slide pin holes formed within the inner rolling body, the slide pin holes having an interior wall and an opening. The interior wall has an arc-shaped indentation that is formed on a portion of the interior wall of the slide pin holes. The surface contact and friction between the slide pin holes and the slide pins is substantially reduced by the arc-shaped indentation during the sliding movement.

The hooking recess is formed in an inner peripheral surface portion of the outer body, the receiving recess is formed in an outer peripheral surface portion of the inner rolling body, wherein the slide bar having the linearly formed inner side is elastically provided in the locking construction. The plurality of slide pin holes are formed perpendicular to the receiving recess. The plurality of slide pins have grooves that are on different locations on the slide pins, and protrusions differently opposing the grooves so that the grooves when properly aligned may receive the slide bar, and the protrusions may be received by the openings.

The plurality of slide pin holes and slide pins can take various configurations that minimizes the friction and surface contact between the slide pins and the slide pin holes. The preferred embodiment has the slide pins rectangular in shape, with the slide pin holes substantially rectangular, with the one or more arc shaped indentations on the interior wall of the slide pin holes. The elasticity of the slide bar can be accomplished by springs or other methods. The lock construction can include the slide bar and the rectangular slide pins formed extending through the outer fixed body and the inner rolling body. Although the present invention is briefly summarized, the fuller understanding of the invention can be obtained by the following drawings, detailed description and appended claims.

BRIEF DESCRIPTION OF DRAWINGS

These and other features, aspects and advantages of the present invention will become better understood with reference to the accompanying drawings, wherein.

DETAILED DESCRIPTION OF THE PREFERRED EMBODIMENTS

Figure 1:
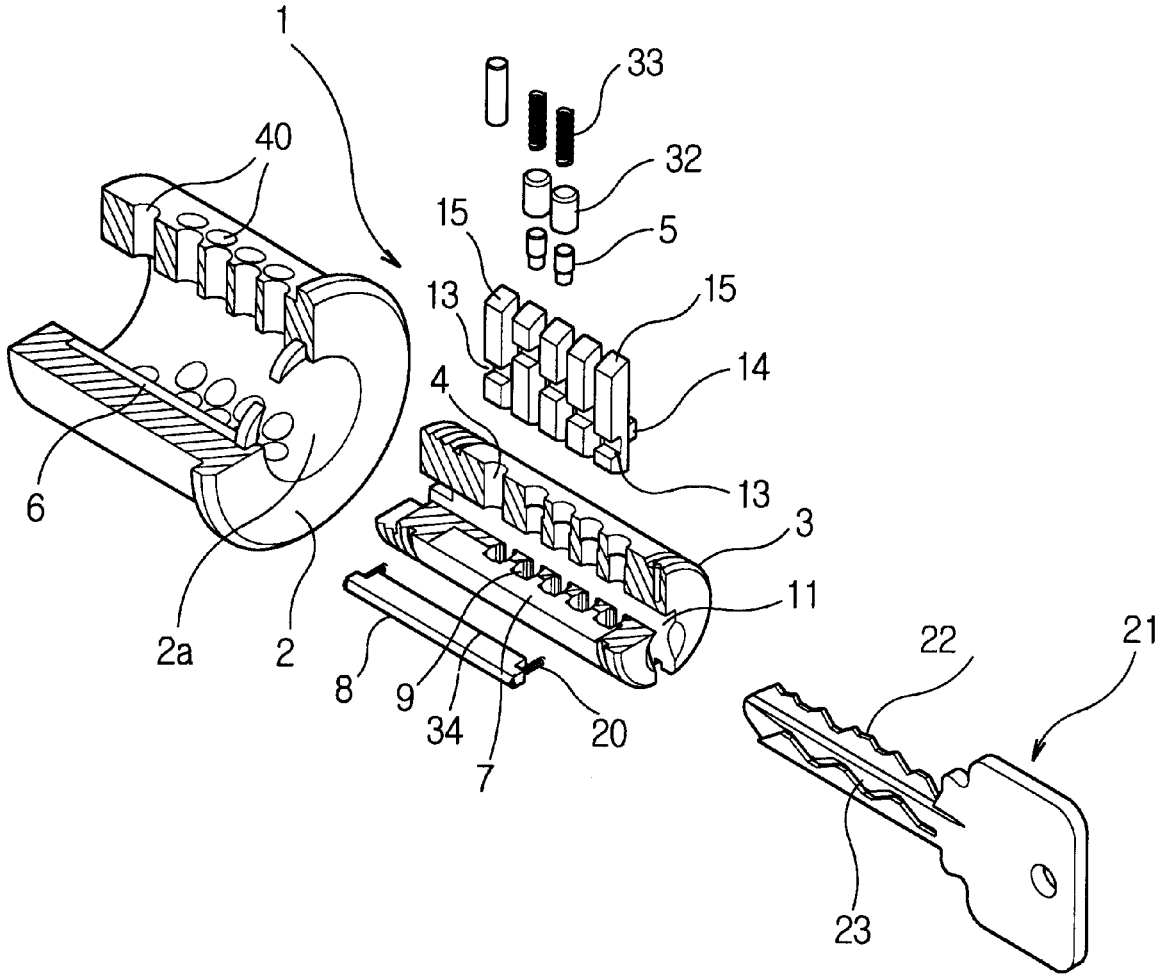
FIG. 1 is an exploded perspective view detailing a locking construction according to an embodiment of the present invention.
Figure 2:
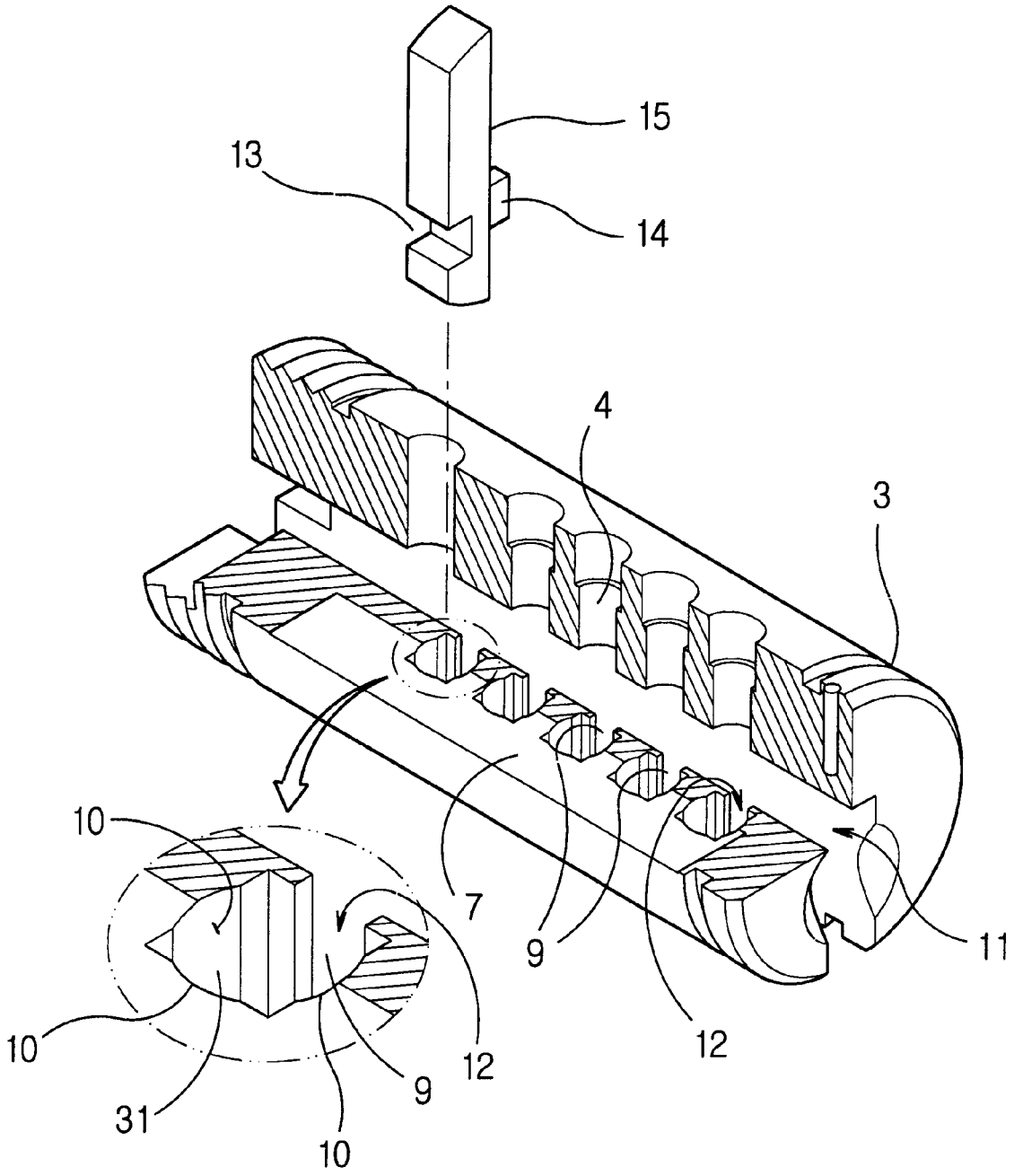
FIG. 2 is a partial enlargement view illustrating an inner rolling body of the locking construction according to the present invention.
Figure 3:
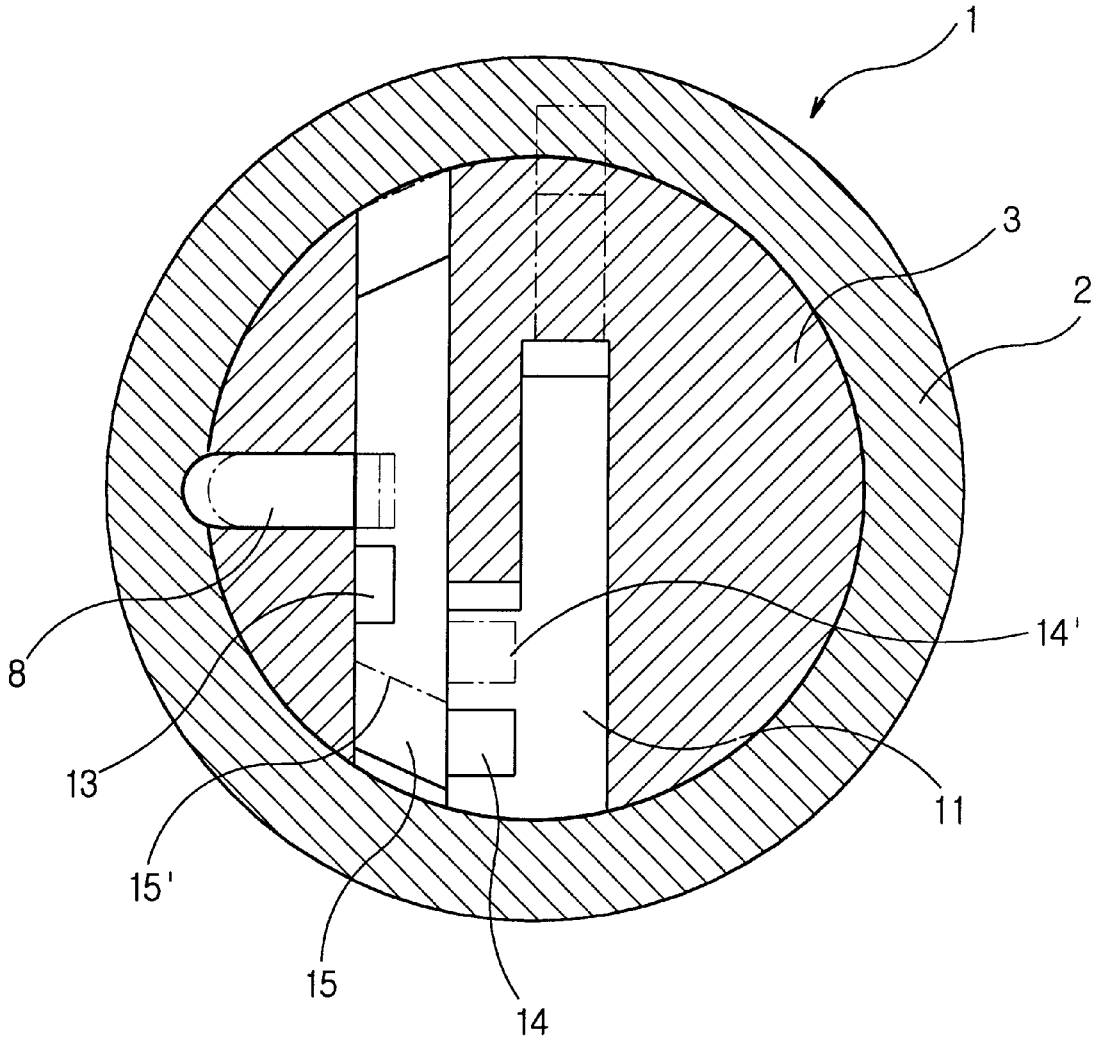
FIG. 3 is a cross sectional front view illustrating operation the lock construction according to the present invention.
Figure 4:
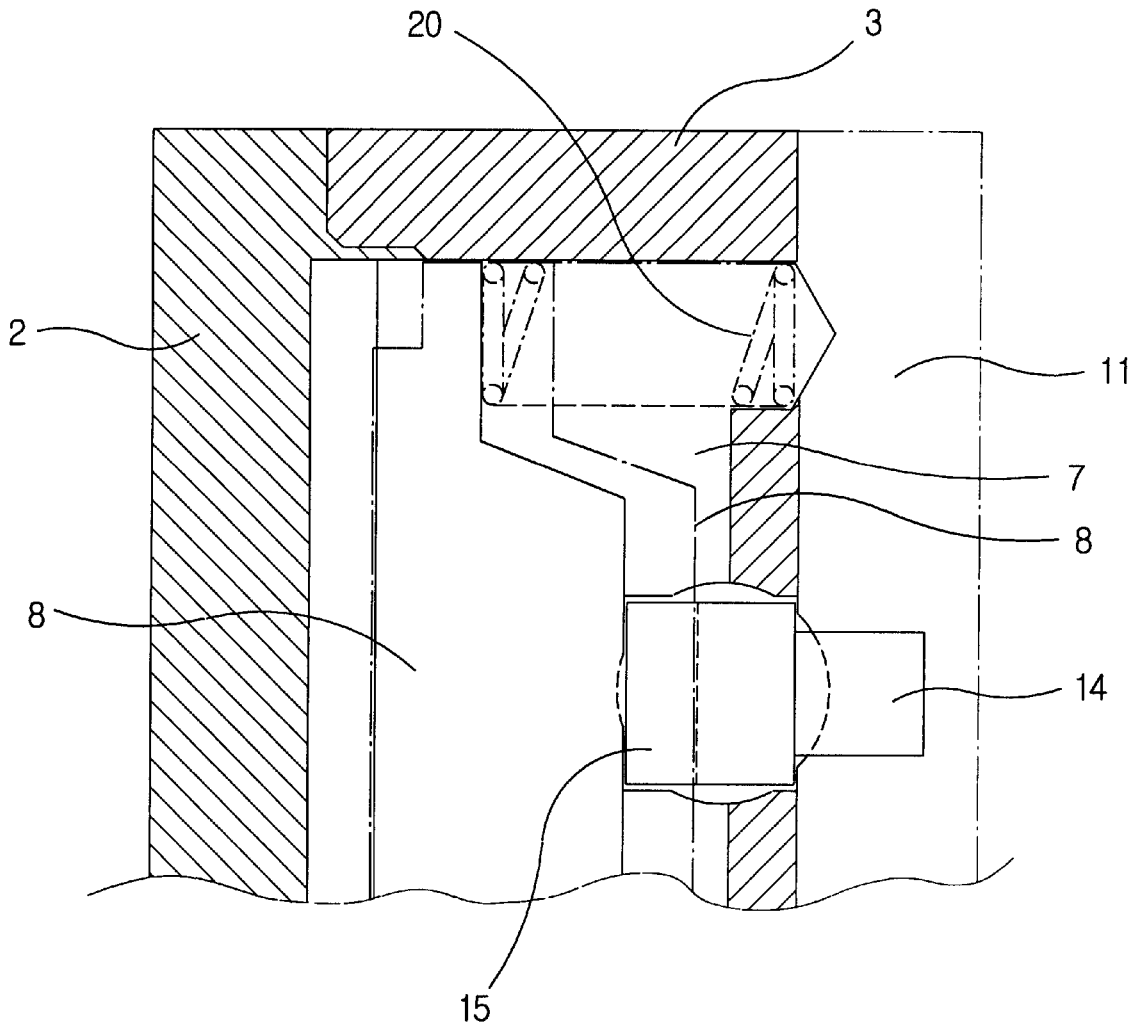
FIG. 4 is a cross sectional plan view illustrating operation of the lock construction according to the present invention.

With reference to the accompanying drawings, FIGS. 1–5, a preferred embodiment will now be described. A lock construction 1 includes an outer fixed body 2 and an inner rolling body 3. The outer fixed body 2 has a hole 2*a* through its center area that receives the inner rolling body 3. The inner rolling body 3 has a plurality of slide holes 4 to slidably receive a plurality of circular pins 5 therethrough. The circular pins 5 are in contact with a sleeve 32 and spring 33. A hooking recess 6 for a slide bar 8 is formed in an inner peripheral portion of the outer fixed body 2 and a receiving recess 7 for the slide bar 8 is formed in an outer peripheral portion of the inner rolling body 3, so that the slide bar 8 having a linearly formed inner side 34 can be received by the hooking recess 6 when locked and can be received by the receiving recess 7 when unlocked. About five slide pin holes 9 of rectangular type are formed perpendicular to the receiving recess 7.

One or more arc-shaped indentations 10, are formed on the interior wall 31 of each slide pin hole 9. The interior wall 31 is formed along the slide pin hole 9. The arc shaped indentations 10, minimized the surface contact with the rectangular slide pins 15. The reduced surface contact significantly enhances the ease of operation of the lock construction mechanism and promotes an extended life cycle for the product, fulfilling major objectives of the inventions. The indentations 10 may take a shape, other than an arc-shape, which still fulfills the objective of reducing surface contact and friction between the rectangular slide pins 15 and the slide pin hole 9. Although not shown, the shape of the indentations 10 can be triangular, square or rectangular.

Each slide pin hole 9 substantially communicates with an inner side portion of the receiving recess 7. Between each slide pin hole 9 and a key hole 11 is an opening 12. A plurality of rectangular slide pins 15 have grooves 13 that are located at different positions and heights on the rectangular slide pins 15. There are protrusions 14 on the opposite side of the grooves 13, so that the grooves 13 may receive the slide bar 8 and the protrusions 14 may open to and be received by the openings 12. The slide pins 15 may be other than a rectangular shape. Circular pin cavities 40 are located in the outer fixed body 2 and receive the sleeves 32 that are circular.

Reference numeral 20 denotes the slide bar operating spring, numeral 21 denotes the key, numeral 22 denotes an upper waved portion of the key, and numeral 23 denotes a side waved portion of the key.

The operation of the lock construction 1 according to the present invention will now be described in further detail. For an unlocking operation, the key 21 is inserted through the key hole 11 of the inner rolling body 3 engaged into the outer fixed body 2. Then, the upper waved portion 22 of the key 21 aligns the circular slide pins 5 disposed through a mid portion of the inner rolling body 3. The side waved portion 23 of the key 21 operates relative to the protrusions 14 so that the grooves 13 formed opposite the protrusions 14 are aligned communicating through the receiving recess 7, whereby the slide bar 8 moves into the receiving recess 7. At this time, when the rectangular slide pins 15 fluctuate through the respective slide pin holes 9, the arc-shaped indentations 10 formed on each inner surface of the slide pin holes 9 decrease the surface friction area, thereby smoothing the fluctuation movement of the rectangular slide pins 15. It is a substantial advantage to reduce the surface area contact between the rectangular slide pins 15 and the slide pin holes 9 to improve ease of operation in the locking and unlocking steps.

When the key 21 is turned at the above stage, the slide bar 8 becomes discharged from the hooking recess 6 formed in the outer fixed body 2 and forces against the inner wall of the outer fixed body 2. The pressure of the slide bar 8 against the inner wall of the outer fixed body 2 forces the slide bar 8 into the receiving recess 7. Subsequently, the slide bar 8 becomes inserted into the receiving recess 7 and the grooves 13, having been discharged from the hooking recess 6, thereby completing the unlocking operation. At this time, the slide bar operating spring 20 becomes compressed by the force of the inner wall of the outer fixed body 2 pressing against the slide bar 8.

Also, for a locking operation, the rolling body 3 and the fixed body 2 are placed at an initial stage and the key 21 is pulled out. Then, the circular slide pins 5 becomes astray in zigzag from alignment and link both the fixed body 2 and the rolling body 3. The slide bar 8 is partially released due to elasticity of the slide bar operating spring 20 and hooks back into the hooking recess 6. At the same time, the rectangular slide pins 15 fall down or disperse vertically by their own weights, thereby blocking the receiving recess 7 and maintaining the locking stage. The outer fixed body can include a plurality of circular pin cavities 40 that receive the circular pins 5.

As described above, the lock construction according to the present invention provides the slide bar 8 having a linearly formed inner side 34 and rectangular slide holes 9 and rectangular slide pins 15 with grooves 13 that are on different locations on the slide pins 15, thereby minimizing pin shape and friction coefficient while smoothing the locking/unlocking operation. Further, the thusly realized solid and smooth lock construction has a simplified structure, thereby improving productivity.

Figure 5:
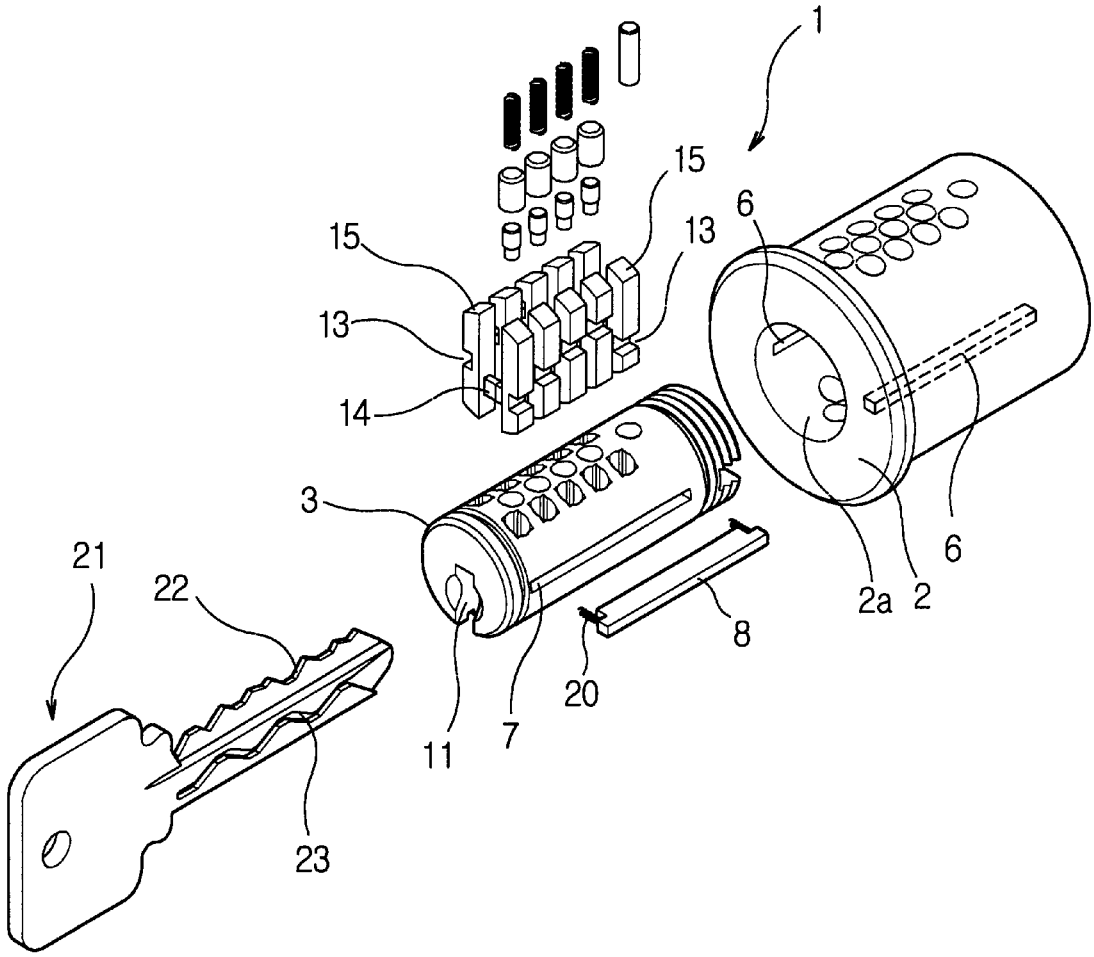
FIG. 5 is an exploded perspective view illustrating a locking construction according to another embodiment of the present invention with a double row of rectangular slide pins.
Figure 6:
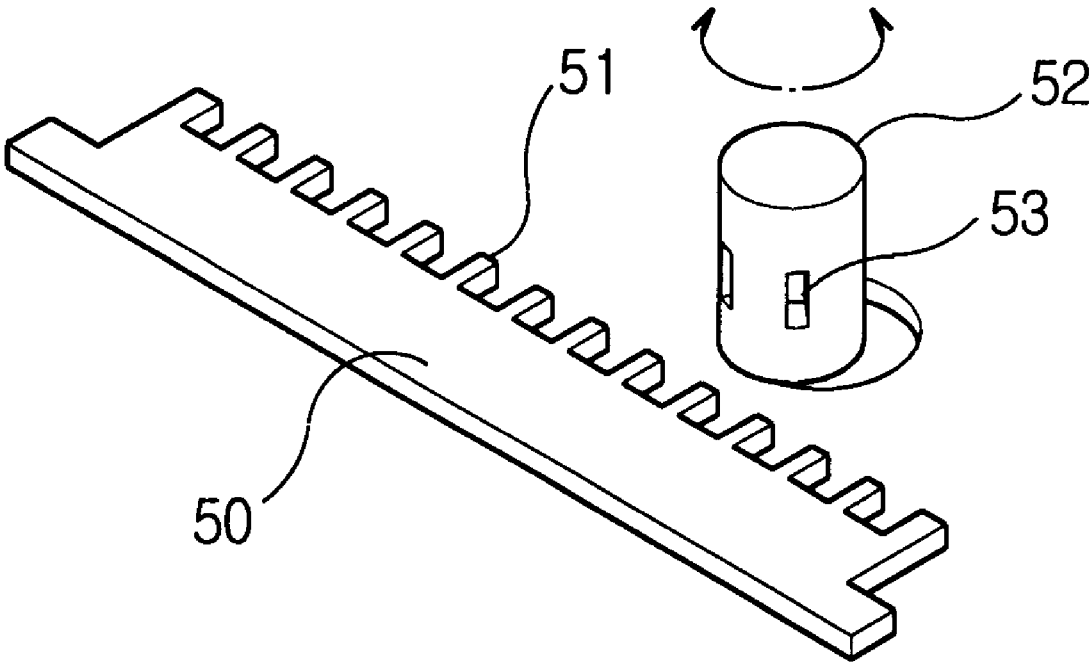
Fig.6 Prior Art
FIG. 6 is a perspective view illustrating main parts of a lock construction according to the prior art.

FIG. 5 illustrates a double row of rectangular slide pins 15 and slide pin holes 9. As shown in FIG. 6, a slide bar according to a conventional lock includes a plurality of protrusions 51 along the inner side of the slide bar 50. A plurality of recesses 53 are formed along the outer periphery of the pin 52.

In further explanation and detail, a lock construction 1 can include an outer fixed body 2 having a hooking recess 6 and a hole that receives the inner rolling body 3. An inner rolling body 3 having a receiving recess 7; and a slide bar 8 having a linearly formed inner side 34. A plurality of slide pins 15 having grooves 13 and protrusions 14. A plurality of slide pin holes 9 formed within the inner rolling body 3, the slide pin holes. The interior wall 31 has an arc-shaped indentation 10 formed on a portion of the interior wall 31 of the slide pin holes 9.

The surface contact and friction between the slide pin holes 9 a and the slide pins 15 i s substantially reduced by the arc-shaped indentation 10 during the sliding movement.

The hooking recess 6 is formed in an inner peripheral surface portion of the outer body 2 and the receiving recess 7 is formed in an outer peripheral surface portion of the inner rolling body 3. The slide bar 8 having the linearly formed inner side 34 is elastically provided in the locking construction 1. The plurality of slide pin holes 9 are formed perpendicular to the receiving recess 7. The plurality of slide pins have groove 13 that are on different locations on the slide pins 15, and protrusions 14 located at the opposite side of the grooves 13 so that the grooves 13 when properly aligned may receive the slide bar 8, and the protrusions 14 may be received by the openings 12.

The slide pins 15 are rectangular in shape and the plurality of slide pin holes 9 are substantially rectangular, having the one or more arc shaped indentations 10 on the interior wall 31 of the slide pin holes 9. The elasticity of the slide bar 8 can be accomplished by springs 20. A version can include five slide pin holes 9 and five slide pins 15. Although not shown, the slide bar 8 and the rectangular slide pins 15 can be formed extending through the outer fixed body 2 and the inner rolling body 3.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A lock construction comprising:

a) an outer fixed body having a hooking recess and a hole;

b) an inner rolling body that is received through the hole in the outer fixed body, the inner rolling body having a receiving recess and a plurality of slide pin holes; wherein the plurality of slide pin holes are formed within the inner rolling body, the slide pin holes having an interior wall and an opening, c) a slide bar having a linearly formed inner side; wherein the hooking recess and the receiving recess both receive the slide bar; and d) a plurality of slide pins having grooves and protrusions, wherein the slide pin holes receive the slide pins, wherein the hooking recess for the slide bar is formed in an inner peripheral surface portion of the outer body, the receiving recess for the slide bar is formed in an outer peripheral surface portion of the inner rolling body, wherein the slide bar having the linearly formed inner side is elastically provided in the locking construction, wherein the plurality of slide pin holes are formed perpendicular to the receiving recess, wherein the plurality of slide pins have the grooves that are on different locations along the slide pins, and the protrusions located at the opposite sides of the grooves so that the grooves when properly aligned may receive the slide bar, and the protrusions may be received by the openings, wherein the slide pins are rectangular in shape, wherein the interior wall is provided along the slide pin hole, and wherein the plurality of slide pin holes are substantially rectangular, having the one or more indentations on the interior wall of the slide pin holes.

2. The lock construction of claim 1, wherein the indentations are arc-shaped.

3. The lock construction of claim 1, wherein the elasticity of the slide bar is accomplished by springs.

4. The lock construction of claim 3 wherein there are five slide pin holes and five slide pins.

* * * * *